US007228708B2

(12) United States Patent
Taras et al.

(10) Patent No.: US 7,228,708 B2
(45) Date of Patent: Jun. 12, 2007

(54) MULTI-TEMP SYSTEM WITH TANDEM COMPRESSORS AND REHEAT FUNCTION

(75) Inventors: Michael F. Taras, Fayetteville, NY (US); Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 277 days.

(21) Appl. No.: 10/975,869

(22) Filed: Oct. 28, 2004

(65) Prior Publication Data

US 2006/0090504 A1 May 4, 2006

(51) Int. Cl.
*F25B 1/00* (2006.01)

(52) U.S. Cl. ..... 62/510; 62/196.4; 62/498; 62/513

(58) Field of Classification Search ..... 62/510, 62/513, 90, 196.4, 324.1, 498
See application file for complete search history.

(56) References Cited

U.S. PATENT DOCUMENTS 4,711,094 A * 12/1987 Ares et al. ..... 62/90
5,666,813 A * 9/1997 Brune ..... 62/90
5,826,443 A * 10/1998 Ares et al. ..... 62/324.1

OTHER PUBLICATIONS

International Search Report Dated Dec. 4, 2006 *U.S. References 4,711,094 & 5,666,813 already cited by examiner*.

* cited by examiner

*Primary Examiner*—Melvin Jones
(74) *Attorney, Agent, or Firm*—Carlson, Gaskey & Olds

(57) ABSTRACT

A tandem compressor system is disclosed that delivers compressed refrigerant to a common discharge manifold, and then to a common condenser. From the common condenser, the refrigerant passes to a plurality of evaporators, with each of the evaporators being associated with a separate environment to be conditioned. A reheat function is provided by a reheat coil(s) for one or several environments such that desired temperature and humidity levels are achieved. Various reheat concepts and system configurations are disclosed, where the reheat coils are interconnected or independent from each other, as well as each evaporator is associated with a single or a plurality of the reheat coils.

39 Claims, 3 Drawing Sheets

MULTI-TEMP SYSTEM WITH TANDEM COMPRESSORS AND REHEAT FUNCTION

BACKGROUND OF THE INVENTION

This application relates to a refrigerant system utilizing tandem compressors sharing a common condenser, but having separate evaporators, and incorporating air reheat means by using refrigerant circulating throughout the system.

Refrigerant systems are utilized in applications to change the temperature and humidity or otherwise condition the environment. In a standard refrigerant system, a compressor delivers a compressed refrigerant to a condenser. From the condenser, the refrigerant passes through an expansion device, and then to an evaporator. As air is blown over the evaporator, moisture is removed from the air and its temperature is reduced. From the evaporator, the refrigerant returns to the compressor. Of course, basic refrigerant cycles are utilized in combination with many configuration variations and optional features. However, the above provides a brief understanding of the fundamental concept.

In more advanced refrigerant cycles, a capacity of the refrigerant system can be controlled by the implementation of so-called tandem compressors. The tandem compressors are normally connected together via common suction and common discharge manifolds. From a single common evaporator, the refrigerant is returned through a common suction manifold to each of the tandem compressors. From the individual compressors the refrigerant is delivered into a common discharge manifold and then into a common single condenser. The tandem compressors are also separately controlled and can be started and shut off independently of each other such that one or both compressors may be operated at a time. By controlling which and how many compressors are running, control over the capacity of the entire system is achieved. Often, the two compressors are selected to have different sizes, such that even greater flexibility in capacity control is provided. Also, tandem compressors may have shutoff valves to isolate some of the compressors from the active refrigerant circuit, when they are shutdown. Moreover, to improve compressor lubrication, pressure equalization and oil equalization lines are frequently employed.

One advantage of the tandem compressor system is that more capacity control is provided, without the requirement of having each of the compressors operating on a dedicated circuit. This reduces the overall system cost.

However, certain applications require cooling at various temperature levels. For example, low temperature (refrigeration) cooling can be provided to a refrigeration case by one of the evaporators connected to one compressor and intermediate temperature (perishable) cooling can be supplied by another evaporator connected to another compressor. In another example, a computer room and a conventional room would also require cooling loads provided at different temperature levels, which can be achieved by the proposed multi-temp system as desired. However, the cooling at different levels will not work with application of a conventional tandem compressor configuration, because a separate evaporator for each cooling level would be required. Thus, non-tandem independent compressors must be used in a dedicated circuit for each cooling level. Furthermore, each circuit must be equipped with a dedicated compressor, dedicated evaporator, dedicated condenser, dedicated expansion device, and dedicated evaporator and condenser fans. This arrangement having a dedicated circuitry for each temperature level would be extremely expensive.

In some cases, while the system is operating in a cooling mode, the temperature level at which the air is delivered to provide comfort environment in a conditioned space may need to be higher than the temperature that would provide the ideal humidity level. Generally, the lower the temperature of the evaporator coil more moisture can be removed from the air stream. These opposite trends have presented challenges to refrigerant system designers. One way to address such challenges is to utilize various schematics incorporating reheat coils. In many cases, a reheat coil placed in the way of an indoor air stream behind the evaporator is employed for the purposes of reheating the air supplied to the conditioned space after it has been cooled in the evaporator, where the moisture has been removed as well.

While reheat coils have been incorporated into air conditioning systems, they have not been utilized in an air conditioning system having an ability to operate at multiple temperature levels.

This invention offers a solution to this problem where tandem compressors can be used for operating a refrigerant system at multiple distinct temperature levels, and with the system control and operation flexibility provided by a reheat coil.

SUMMARY OF THE INVENTION

In this invention, as opposed to the conventional tandem compressor system, there is no common suction manifold connecting the tandem compressors together. Each of the tandem compressors is connected to its own evaporator, while both compressors are still connected to a common discharge manifold and a single common condenser. Consequently, for such tandem compressor system configurations, additional temperature levels of cooling, associated with each evaporator, become available. An amount of refrigerant flowing through each evaporator can be regulated by flow control devices placed at the compressor suction ports, as well as by controlling related expansion devices or utilizing other control means such as evaporator airflow.

In addition, a reheat coil(s) is connected to be associated with at least one of the evaporators. The reheat coil allows the refrigerant system designer to lower the temperature of the air passing over the particular evaporator, and remove a desired amount of moisture. Then, the air can be reheated by the reheat coil(s) to maintain a required temperature level in the conditioned space.

In disclosed embodiments of this invention, precise control of various sub-sections of the environment can be achieved by utilizing distinct evaporators for each separate sub-section. Each of the evaporators communicates with a separate compressor, while the compressors deliver compressed refrigerant through a common discharge manifold to a common condenser. In this manner, a separate environmental control in each of the conditioned zones is achieved, and there is no necessity of providing a complete set of the components of multiple individual refrigerant circuits (such as additional condensers and condenser fans).

Only a single evaporator may be associated with a corresponding reheat coil to condition respective sub-environment, or several evaporators may have reheat coils positioned behind them. Also, a single evaporator may be associated with multiple reheat coils (interconnected or fully independent) providing various levels of reheat. Furthermore, if there are plural interconnecting reheat coils (associated with a single or multiple evaporators), they may be arranged in a parallel or serial configuration with each other. A fully independent reheat coil may utilize refrigerant vapor from the compressor discharge port, warm refrigerant liquid downstream of the condenser or a two-phase refrigerant mixture (of gas and liquid) and consequently be configured in a parallel or sequential (upstream or downstream) manner with respect to the system condenser.

The controls and times when the reheat coil would be best utilized would be within the skill of a worker in this art.

These and other features of the present invention can be best understood from the following specification and drawings, the following of which is a brief description.

DETAILED DESCRIPTION OF THE PREFERRED EMBODIMENT

Figure 1:
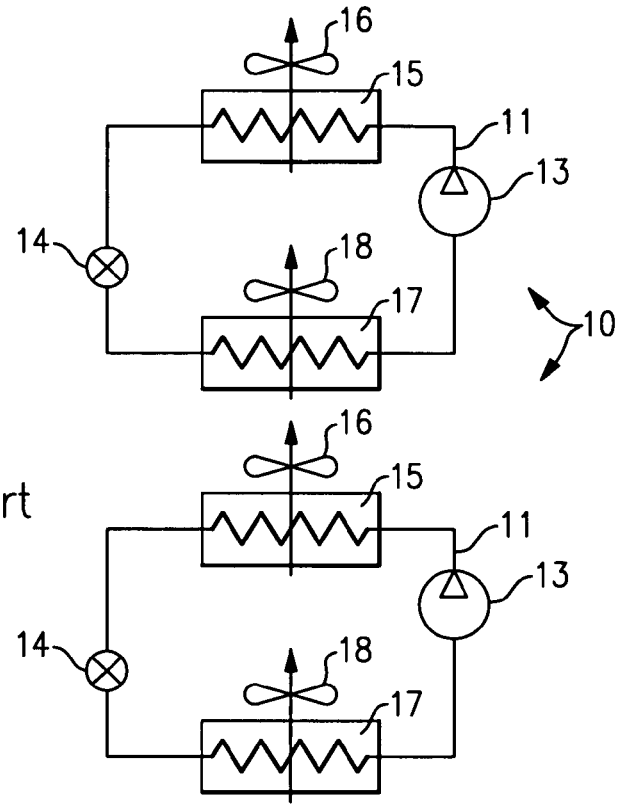
FIG.1 Prior Art
FIG. 1 shows the prior art.

Referring to FIG. 1, a conventional prior art multi-level (bi-level in this case) system 10 is shown to include two separate circuits 11 to serve sub-sections of the environment at different temperature levels. Each basic circuit 11 includes a dedicated evaporator 17, condenser 15, compressor 13, expansion device 14, condenser fan 16, evaporator fan 18 and associated piping. As known, each circuit can be controlled to maintain a desired evaporator temperature by various means and thus provide multi-level cooling to the environment. As mentioned above, such conventional approach is cumbersome and requires a significantly higher cost for system manufacturing and operation. An improvement over this prior art is disclosed in co-pending U.S. patent application Ser. No. 10/975,887 filed on Oct. 28, 2004 and entitled "Refrigerant Cycle With Tandem Compressors for Multi-Level Cooling." In this disclosed system, a plurality of evaporators are provided to achieve various temperature levels in different sub-environments by efficient and cost-effective means of utilization of tandem compressors. While this system does provide significant benefits in operation, control and manufacturing, it would be desirable to provide better dehumidification capability and flexibility for such a system.

Figure 2:
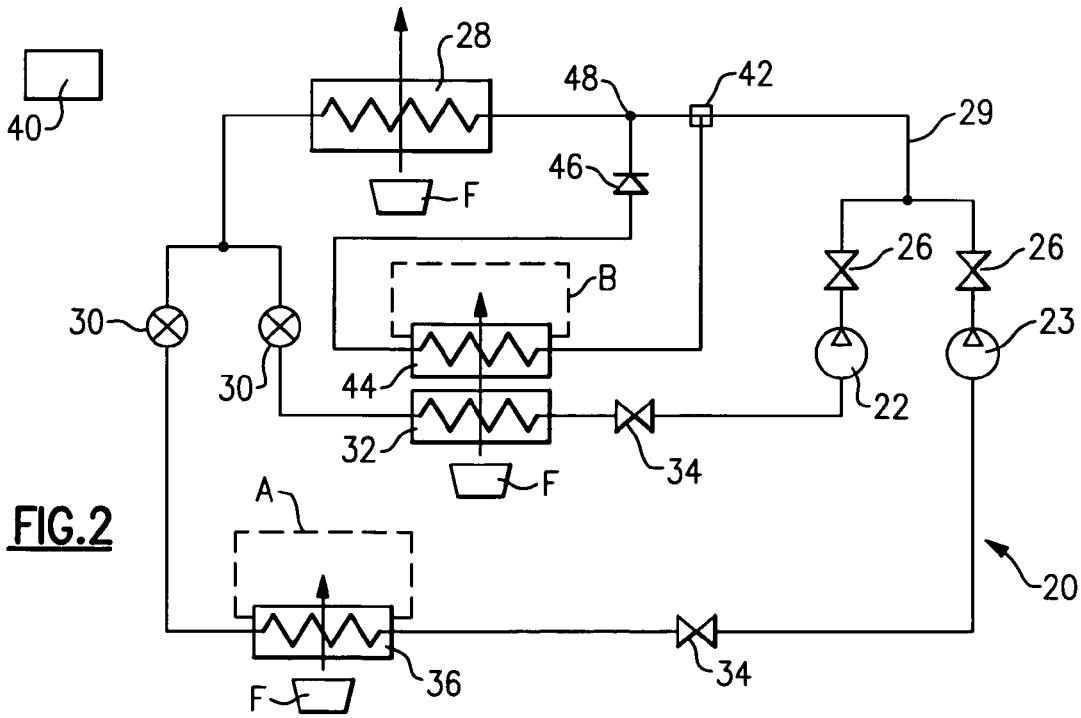
FIG. 2 is a first schematic.

A refrigerant system 20 is illustrated in FIG. 2 having a pair of compressors 22 and 23 that are operating generally as tandem compressors. Optional discharge valves 26 are positioned downstream of these compressors on discharge lines associated with each of the compressors 22 and 23. These valves can be controlled to prevent backflow of refrigerant to either of the compressors 22 or 23 should only one of the compressors be operational. That is, if for instance the compressor 22 is operational with the compressor 23 stopped, then the discharge valve 26 associated with the compressor 23 will be closed to prevent high to low leakage through the compressor 23 from a common condenser 28 to an evaporator 36 associated with the compressor 23. In case the discharge valves 26 are of an adjustable type (by modulation or pulsation), an additional degree of system performance control can be provided. The two compressors communicate with a discharge manifold 29 leading to the common condenser 28.

From the condenser 28, the refrigerant continues downstream and is split into two flows, each heading through an expansion device 30. From the expansion device 30, one of the flows passes through a first evaporator 32 for conditioning a sub-environment B. The refrigerant passing through the evaporator 32 then passes through an optional suction modulation valve 34, and is returned to the compressor 22. The second refrigerant flow passes through the evaporator 36 that is conditioning a sub-environment A. This refrigerant also passes through an optional suction modulation valve 34 downstream of the evaporator 36 and is returned to the compressor 23. Usually, sub-environments A and B are preferably maintained at different temperature levels.

A control 40 for the refrigerant system 20 is operably connected to control the compressors 22 and 23, the expansion devices 30 (if electronically controlled), suction modulation valves 34 and discharge valves 26. By properly controlling each of these components in combination, the conditions at each evaporator 32 and 36 can be maintained as necessary for the sub-environments A and B. The exact controls necessary are as known in the art, and will not be explained here. However, the use of the tandem compressors 22 and 23 utilizing a common condenser 28 and separate evaporators 32 and 36, preferably operating at different temperature levels, reduces the number of components necessary for providing the independent control for the sub-environments A and B, and thus is an improvement over the prior art.

The schematic of FIG. 2 also incorporates a reheat circuit associated with one of the two evaporators 32 and 36. It should be understood that while a specific reheat schematic is disclosed, any other reheat concept or configuration option can also be utilized in the present invention. Thus, the location of where the reheat refrigerant is tapped, the position of the reheat branch in relation to other system components, etc., can all be modified in schematics according to this invention. For instance, the FIG. 2 exhibits a hot gas reheat concept with the reheat coil and condenser arranged in a sequential manner. Other schematics, utilizing hot gas, warm liquid or two-phase refrigerant mixture, can equally benefit from the teaching of the invention. As known, in these design configurations, the reheat coil can be positioned upstream or downstream of the condenser and in a parallel or sequential arrangement. In the FIG. 2 schematic, the reheat circuit is shown as having a three-way valve 42 for selectively tapping at least a portion of the refrigerant in the discharge line 29 to a downstream reheat coil 44, when the reheat function is desired and activated. As shown, the reheat coil 44 is in the path of the air driven by an air-moving device such as fan F across the evaporator 32, and thus, the reheat coil 44 further conditions (reheats) the air heading toward the sub-environment B. As is known, the reheat coil is typically placed to receive refrigerant that is at higher temperature than the refrigerant in the evaporator, and thus the refrigerant in the reheat coil is capable to reheat at least a portion of the air having passed over the evaporator 32, where its temperature and humidity levels have been reduced. In this way, moisture can be removed from the air passing through the evaporator 32 to achieve a desired humidity level, and the air stream can then be reheated in the reheat coil 44 to achieve a desired temperature level, providing comfort conditions in sub-environment B. As shown, a check valve 46 is positioned downstream of the reheat coil 44, and the reheat refrigerant re-enters the main refrigerant cycle downstream of check valve 46 and approaches the condenser 28 at a point 48.

The control 40 also controls the three-way valve 42, to utilize the reheat coil 44, when the reheat function is desirable. The three-way valve 42 can be of a shutoff or adjustable type, the latter controlled through a modulation or pulsation technique. As is shown in this figure, the reheat coil may not be necessary for each of the sub-environments A and B.

Figure 3:
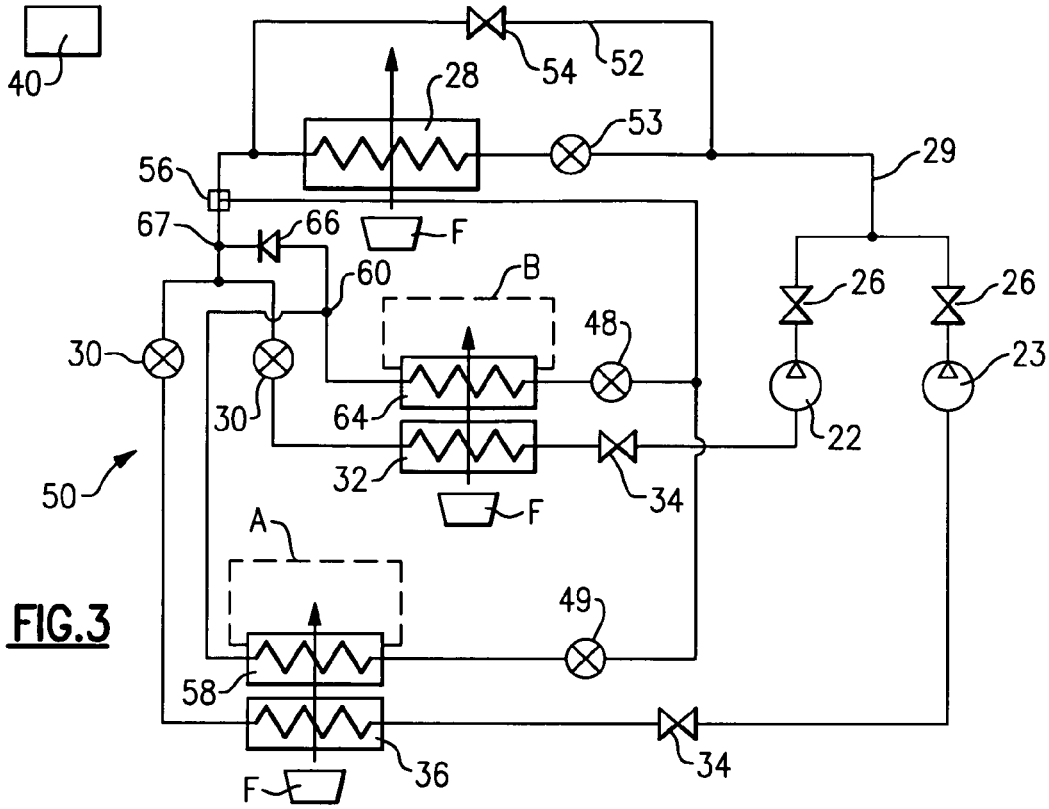
FIG. 3 is a second schematic.

FIG. 3 shows another embodiment 50. In the embodiment 50, both sub-environments A and B are conditioned by reheat coils. The three-way valve 56 is now positioned downstream of the condenser 28 so that the warm liquid or two-phase refrigerant mixture reheat concept can be utilized. When the reheat function is desired, at least a portion of refrigerant approaches a first reheat coil 58, and is returned to a point 60, where it is reconnected to flow downstream of a second reheat coil 64. As shown, the reheat coil 64 is tapped at a point 62 from the refrigerant approaching the reheat coil 58. Refrigerant from both reheat coils 58 and 64 passes through the check valve 66 and then re-communicates at a point 67 with the main refrigerant circuit. Optional flow control devices such as valves 48 and 49 can be incorporated into the reheat schematics such that each of the coils 58 and 64 can be selectively operated, when the reheat function is required to achieve comfort conditions in sub-environments A and B respectively. The valves 48 and 49 also can be an on/off or adjustable (by modulation or pulsation) type, the latter to control an amount of refrigerant passing through each reheat coil. Again, the controls and times when it would be desirable to operate one reheat coil without the other or both coils in conjunction with each other would be within the skill of a worker in this art.

With this embodiment, the reheat coils effectively operate in parallel, and thus the refrigerant at each of the reheat coils 58 and 64 should be at generally the same condition. Again, the advantages of the schematic are transparent to any reheat concept.

The embodiment shown in FIG. 3 also has the feature of a selective bypass around the condenser 28. Thus, a bypass line 52 with a flow control device such as valve 54 allows refrigerant to bypass the condenser when full cooling capability may not be necessary, but dehumidification may be desirable. Additionally, a valve 53 may be placed upstream of the condenser 28 to allow for full refrigerant bypass through the bypass line 52. The valves 53 and 54 can be of any shutoff of adjustable type as well. Again, a worker of ordinary skill in the art would recognize when it would be desirable to operate the bypass function.

Figure 4:
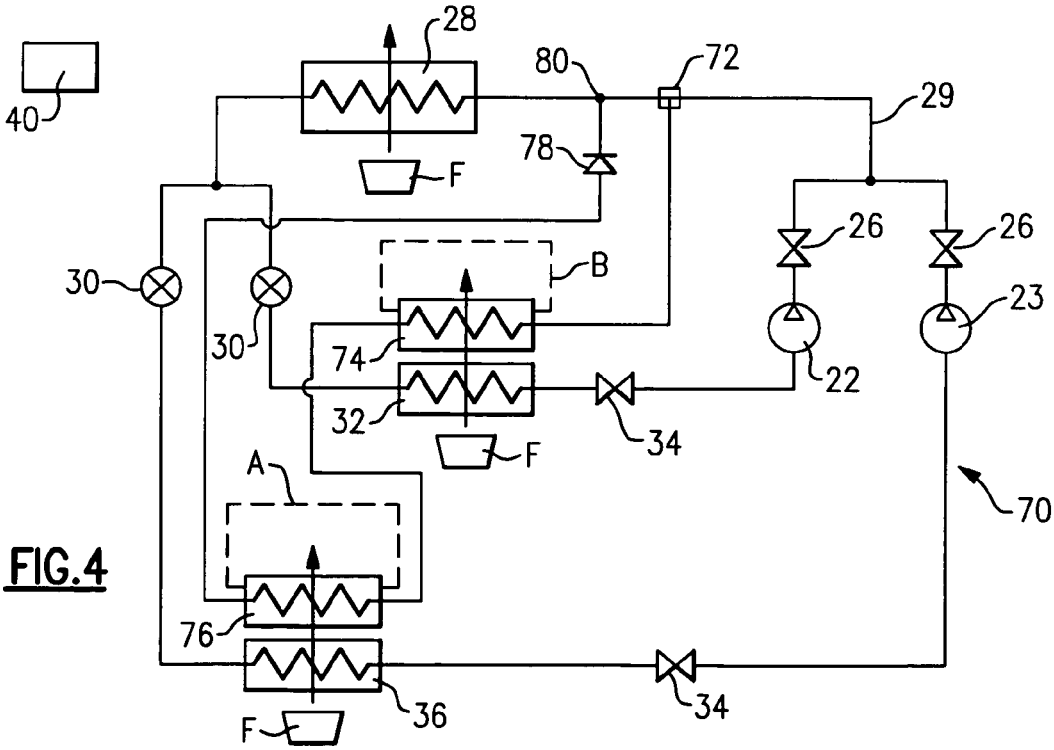
FIG. 4 is a third schematic.

FIG. 4 shows yet another embodiment 70. In the embodiment 70, a three-way valve 72 selectively communicates refrigerant to a reheat coil 74 first, and then downstream to a reheat coil 76. The refrigerant returns to a main circuit at a point 80 through a check valve 78. In this embodiment, the reheat coil 74 and 76 are essentially in a serial flow relationship, and thus the refrigerant approaching the reheat coil 76 will be cooler than it was at the reheat coil 74 and thus have a lower thermal potential. A worker of ordinary skill in the art would recognize which of the two sub-environments A and B would desirably have the first reheat coil 74, depending upon the cooling load and a desired conditions in that environment. Once again, the obtained benefits are independent of a particular reheat concept.

Figure 5:
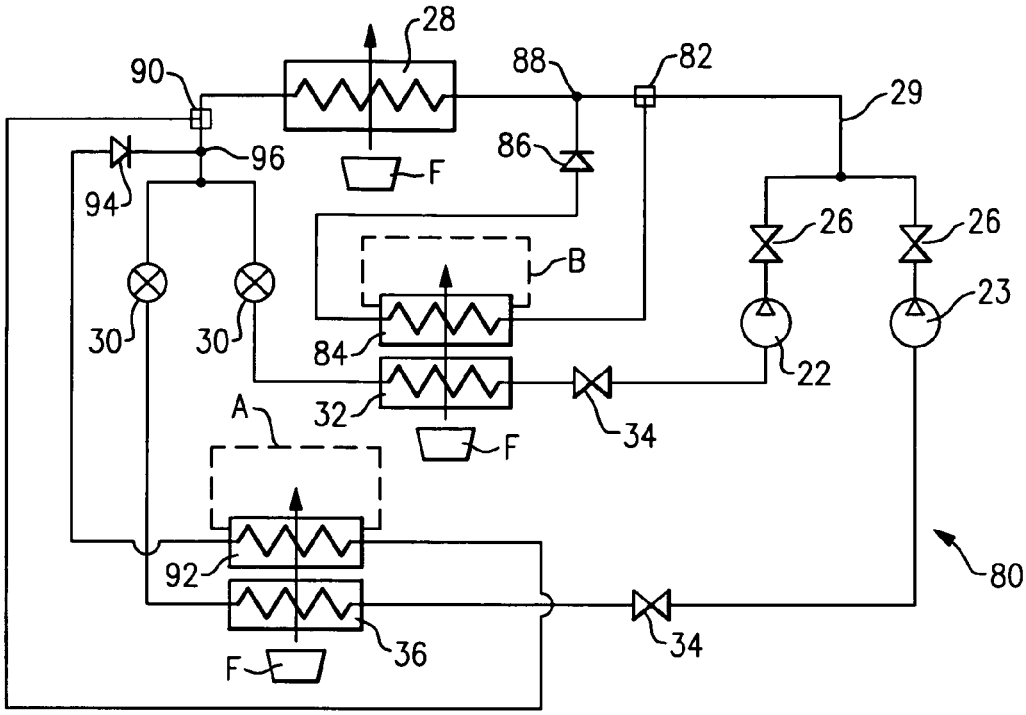
FIG. 5 is a fourth schematic.

FIG. 5 shows yet another embodiment 80. In the embodiment 80, a first three-way valve 82 selectively communicates refrigerant through a reheat coil 84, and then through a check valve 86 to re-communicate at a point 88 to a main refrigerant circuit. This reheat branch utilizes a sequential hot gas concept and taps and returns refrigerant upstream of a condenser 28. A second three-way valve 90 communicates refrigerant through a reheat coil 92, through a check valve 94, and is reconnected at a point 96 to the main refrigerant circuit. This reheat branch employs warm liquid approach and taps and returns refrigerant downstream of the condenser 28 but upstream of expansion devices 30. Thus, FIG. 5 shows another embodiment wherein two entirely separate reheat circuits and different reheat concepts are utilized to condition sub-environments A and B.

Figure 6:
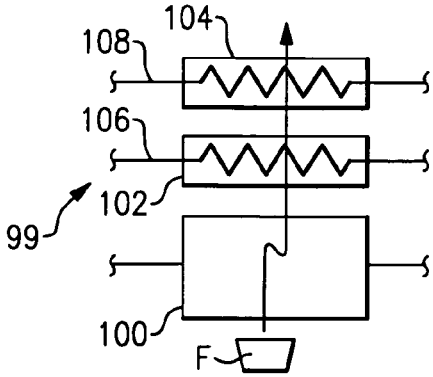
FIG. 6 is a fifth schematic.

FIG. 6 shows another embodiment 99, wherein an air-moving device such as fan F associated with an evaporator 100 passes at least a portion of air serially over a pair of reheat coils 102 and 104. The reheat coils 102 and 104 can receive the refrigerant from separate lines 106 and 108, and pass that refrigerant back to the main refrigerant circuit at any location. In this manner, distinct refrigerant conditions can be achieved within the reheat coils 102 and 104, and the control associated with the system 99 can utilize either or both of the reheat coils to provide stages of reheat and achieve desired environmental conditions. As mentioned before, the refrigerant lines 106 and 108 leading to the reheat coils 102 and 104 can be tapped from different or the same location in the main refrigerant circuit. In the latter case, the reheat coils 102 and 104 can be connected serially or parallel by the refrigerant lines.

Figure 7:
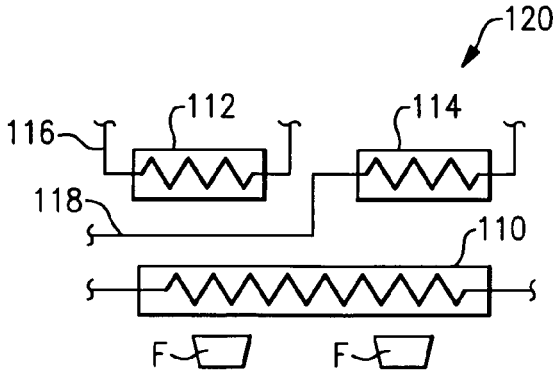
FIG. 7 is a sixth schematic.

FIG. 7 shows an embodiment, wherein the two reheat coils 112 and 114 associated with an evaporator 110 are essentially in a parallel relationship relative to the airflow. Separate fans F, or some type of flow diversion (such as a partition, a set of louvers, etc.), can be utilized such that air could be passed over either of the two reheat coils when desired. Here again, the reheat coils 112 and 114 can receive refrigerant from separate locations in the main refrigerant circuit by refrigerant lines 116 and 118. The air can be passed into an environment to be conditioned by actuating only the fan associated with the reheat coil 112, or only the fan associated with the reheat coil 114. It may also be true that under certain conditions a mixture of air passing over both reheat coils 112 and 114 may be desired. Again, the benefit of the embodiment 120 is that it achieves better flexibility in system operation and control in order to provide comfort in the environment to be conditioned.

Of course, other multiples of compressors and compressor banks and evaporators operating at various multiple temperature levels can be utilized within the scope of this invention.

Obviously, a common condenser can be associated with one of the evaporators as a reheat coil in order to condition respective sub-environment.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A refrigerant system comprising:

a plurality of compressors, where at least two of said compressors deliver a refrigerant to a discharge manifold leading to a common condenser, refrigerant passing through said common condenser, and then expanding into a plurality of evaporators, said plurality of evaporators associated with said plurality of said compressors, where said at least two compressors connected to separate evaporators, such that at least one of said separate evaporators does not deliver refrigerant to each of said of compressors; and at least one reheat coil incorporated into the refrigerant system and associated with at least one of said plurality of evaporators.

2. The refrigerant system as set forth in claim 1, wherein at least one of said plurality of evaporators does not include a reheat coil.

3. The refrigerant system as set forth in claim 1, wherein a suction modulation valve is positioned between at least one of said evaporators and at least one of associated compressors.

4. The refrigerant system as set forth in claim 1, wherein a flow control device is positioned on a discharge line downstream of at least one of said compressors, but upstream of said discharge manifold.

5. The refrigerant system as set forth in claim 1, wherein a separate expansion device is positioned to receive refrigerant heading to at least one of said evaporators.

6. The refrigerant system as set forth in claim 1, wherein there are plural reheat coils each associated with one of said plurality of evaporators.

7. The refrigerant system as set forth in claim 6, wherein said plural reheat coils receive refrigerant flow from a common tap, and are positioned to be in parallel relationship.

8. The refrigerant system as set forth in claim 6, wherein said plural reheat coils receive refrigerant from a common tap and are positioned to be in serial relationship.

9. The refrigerant system as set forth in claim 6, wherein said reheat coils receive refrigerant from separate taps.

10. The refrigerant system as set forth in claim 1, wherein there are plural reheat coils and wherein at least two of said plural reheat coils are associated with at least one of said plurality of evaporators.

11. The refrigerant system as set forth in claim 10, wherein said plural reheat coils are positioned such that at least a portion of air passes serially over them after passing over said at least one evaporator.

12. The refrigerant system as set forth in claim 10, wherein said plural reheat coils are positioned such that at least a portion of air passing over said evaporator passes over only one of said at least two reheat coils.

13. The refrigerant cycle as set forth in claim 1, wherein a refrigerant bypass around said condenser is provided.

14. The refrigerant system as set forth in claim 1, wherein said reheat coil being positioned sequentially with said condenser.

15. The refrigerant system as set forth in claim 14, wherein said reheat coil is located downstream of said condenser.

16. The refrigerant system as set forth in claim 14, wherein said reheat coil is located upstream of said condenser.

17. The refrigerant system as set forth in claim 1, wherein said reheat coil is arranged to be parallel with said condenser.

18. The refrigerant system as set forth in claim 1, wherein a bypass line and flow control device allow bypass of refrigerant around said condenser.

19. The refrigerant system as set forth in claim 1, wherein a refrigerant flowing to said reheat coil can be adjusted through at least one of modulation and pulsation control.

20. A method of operating a refrigerant system comprising the steps of:

1) providing a refrigerant system including a plurality of compressors where at least two of said compressors delivering refrigerant to a common condenser through a discharge manifold, refrigerant passing from said common condenser to a plurality of evaporators, with each of said evaporators delivering refrigerant to one of said plurality of compressors, at least one of said plurality of evaporators being associated with a reheat coil; and 2) operating said refrigerant system by independently controlling refrigerant flow to each of said evaporators and selectively operating said reheat coil.

21. The method as set forth in claim 20, wherein said reheat coil being positioned sequentially with said condenser.

22. The method as set forth in claim 21, wherein said reheat coil is located upstream of said condenser.

23. The method as set forth in claim 21, wherein said reheat coil is located downstream of said condenser.

24. The method as set forth in claim 20, wherein said reheat coil is arranged to be parallel with said condenser.

25. The method as set forth in claim 20, wherein suction modulation valves are provided to control the flow of refrigerant from some of said plurality of evaporators to some of said plurality of compressors.

26. The method as set forth in claim 20, wherein discharge valves are provided to prevent the backflow of refrigerant and control operation of some of said plurality of compressors.

27. The method as set forth in claim 20, wherein at least one of said plurality of evaporators is not associated with the reheat coil.

28. The method as set forth in claim 20, wherein there are plural reheat coils associated with plural evaporators.

29. The method as set forth in claim 20, wherein there are a plurality of reheat coils associated with at least one of said plurality of evaporators.

30. The method as set forth in claim 20, wherein a refrigerant flowing to said reheat coil can be adjusted through at least one of modulation and pulsation control.

31. The method as set forth in claim 28, wherein said reheat coils receive refrigerant flow from a common tap, and are positioned to be in a parallel flow relationship.

32. The method as set forth in claim 28, wherein said plurality of reheat coils receive refrigerant flow from a common tap, and are positioned to be in a serial flow relationship.

33. The method as set forth in claim 28, wherein said plurality of reheat coils receive refrigerant from distinct points in a refrigerant cycle.

34. The method as set forth in claim 20, wherein a bypass line and flow control device allow bypass of refrigerant around said condenser.

35. The method as set forth in claim 20, wherein plural reheat coils are associated with at least one of said plurality of evaporators, and said control selectively passing air over said at least one of said plurality of evaporators, and selectively over said plural reheat coils.

36. The method as set forth in claim 35, wherein at least a portion of air passes serially over said plural reheat coils.

37. The method as set forth in claim 35, wherein said plural reheat coils are positioned such that at least a portion of air passing over one of said reheat coils will not pass over another of said plural reheat coils.

38. The method as set forth in claim 20, wherein each of said evaporators delivers refrigerant to only one of said plurality of compressors.

39. The refrigerant system as set forth in claim 1, wherein each of said plurality of evaporators delivering refrigerant to only one of said at least two compressors.

* * * * *